US006898374B1

(12) United States Patent
Wen

(10) Patent No.: US 6,898,374 B1
(45) Date of Patent: May 24, 2005

(54) FUEL CONTAINER HAVING AIR SUPPLYING DEVICE

(76) Inventor: Shiuan Shiau Wen, P.O. Box 63-298, Taichung (TW), 406

( * ) Notice: Subject to any disclaimer, the term of this patent is extended or adjusted under 35 U.S.C. 154(b) by 0 days.

(21) Appl. No.: 10/706,176

(22) Filed: Nov. 10, 2003

(51) Int. Cl.[7] ..... F24H 1/18

(52) U.S. Cl. ..... 392/459; 123/557; 123/445; 392/441

(58) Field of Search ..... 392/441–445, 392/449; 123/445, 557

(56) References Cited

U.S. PATENT DOCUMENTS 3,956,934 A * 5/1976 White ..... 73/323

4,395,996 A * 8/1983 Davis ..... 123/557

* cited by examiner

*Primary Examiner*—Thor S. Campbell
(74) *Attorney, Agent, or Firm*—Charles E. Baxley

(57) ABSTRACT

A fuel container includes a chamber to receive fuel or petroleum or compressed or liquefied petroleum gases, a conduit extended within the chamber of the container to allow the petroleum to flow into and out of the conduit. A pipe is engaged through the container and engaged into the conduit for supplying air into the petroleum received in the conduit and the chamber of the container. An air supplying device includes a pump for pumping and supplying the air into the pipe, and then into the conduit and the chamber of the container, to gasify the petroleum, for allowing the gasified petroleum to be easily flow to gas stoves or ovens.

13 Claims, 9 Drawing Sheets

FUEL CONTAINER HAVING AIR SUPPLYING DEVICE

BACKGROUND OF THE INVENTION

1. Field of the Invention

The present invention relates to a fuel or petroleum container, and more particularly to a fuel container having an air filling or supplying device to supply air into the container, and to gasify the fuel or the petroleum or the compressed or liquefied petroleum gases.

2. Description of the Prior Art

Typical fuel containers comprise a container body for receiving fuel, gasoline, or compressed or liquefied petroleum gases (LPG or LP gas), or other gases, such as ethyne, therein, and a regulator or a control valve attached to the container body, in order to control the outward flowing of the gas to gaseous ovens, stoves, or the like.

Normally, the compressed or liquefied petroleum gases are in liquid state, and may include a temperature lower than the room temperature, such that the compressed or liquefied petroleum gases may not be suitably changed or converted into a gaseous state, and thus may not be swiftly or suitably supplied to the gaseous ovens or stoves.

Particularly, during the winter season, or when the environment temperature is low, the compressed or liquefied petroleum gases may not be suitably changed or converted into the gaseous state, and such that the users of the gaseous ovens or stoves may not have a stable supplying of the fuel or petroleum or gas for cooking purposes, or for water heating purposes.

Due to the combustible characteristics of the fuel, or gasoline, or petroleum or compressed or liquefied petroleum gases, no heating devices have been developed or provided to heat and to gasify the fuel or the petroleum.

The present invention has arisen to mitigate and/or obviate the afore-described disadvantages of the conventional containers for fuel or petroleum.

SUMMARY OF THE INVENTION

The primary objective of the present invention is to provide a fuel container including an air supplying device to supply air into the container, and to gasify the fuel or the petroleum or the compressed or liquefied petroleum gases.

The other objective of the present invention is to provide a fuel container including a heating device to heat and to gasify the fuel or the petroleum or the compressed or liquefied petroleum gases, in order to easily supply air into the container and to other facilities.

The other objective of the present invention is to provide a fuel container including an air filling device to gasify the fuel or the petroleum or the compressed or liquefied petroleum gases.

In accordance with one aspect of the invention, there is provided a container body including a chamber formed therein, petroleum received in the chamber of the container body, and a heating device for heating the petroleum received in the chamber of the container body, to facilitate gasifying of the petroleum.

The heating device includes a heater attached to the container body, to heat the petroleum received in the chamber of the container body. The container body includes a bracket, the heating device includes a heat conductive member attached to the container body with the bracket, and the heater is attached to the heat conductive member. A switch attached to the container body, and coupled to the heater, to control the heater and to prevent the petroleum from being over heated.

An air supplying device may further be provided for supplying air into the chamber of the container body. The air supplying device includes a pipe engaged into the container body, to supply the air into the petroleum received in the chamber of the container body. The pipe includes a free end having a filter screen attached thereto.

The air supplying device includes a pump coupled to the pipe, to pump the air into the pipe. The air supplying device includes a check valve coupled between the pipe and the pump.

The air supplying device includes a conduit extended within the chamber of the container body, and communicating with the chamber of the container body, to allow the petroleum to flow into and out of the conduit, The pipe is engaged into the conduit for supplying air into the petroleum received in the conduit and the chamber of the container body.

The container body includes a gauge tube attached thereto, and communicating with the chamber thereof, to allow the petroleum to flow into the gauge tube, and to be seen by users. The container body includes a port provided thereon, and a cap attached to the port to open and close the port.

The cap includes a hole formed therein, the hole of the cap is openable when the cap is rotated relative to the port of the container body, to prevent the container body from being over-pressurized.

The container body includes an air outlet device having a valve attached thereto, for controlling the air to flow out of the container body. The air outlet device includes a switch attached to the valve, to control the air to flow out of the valve. The air outlet device includes a pressure gauge attached to the valve, to detect a pressure within the chamber of the container body. The air outlet device includes a relieve valve attached to the valve, to release the air received in the chamber of the container body.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
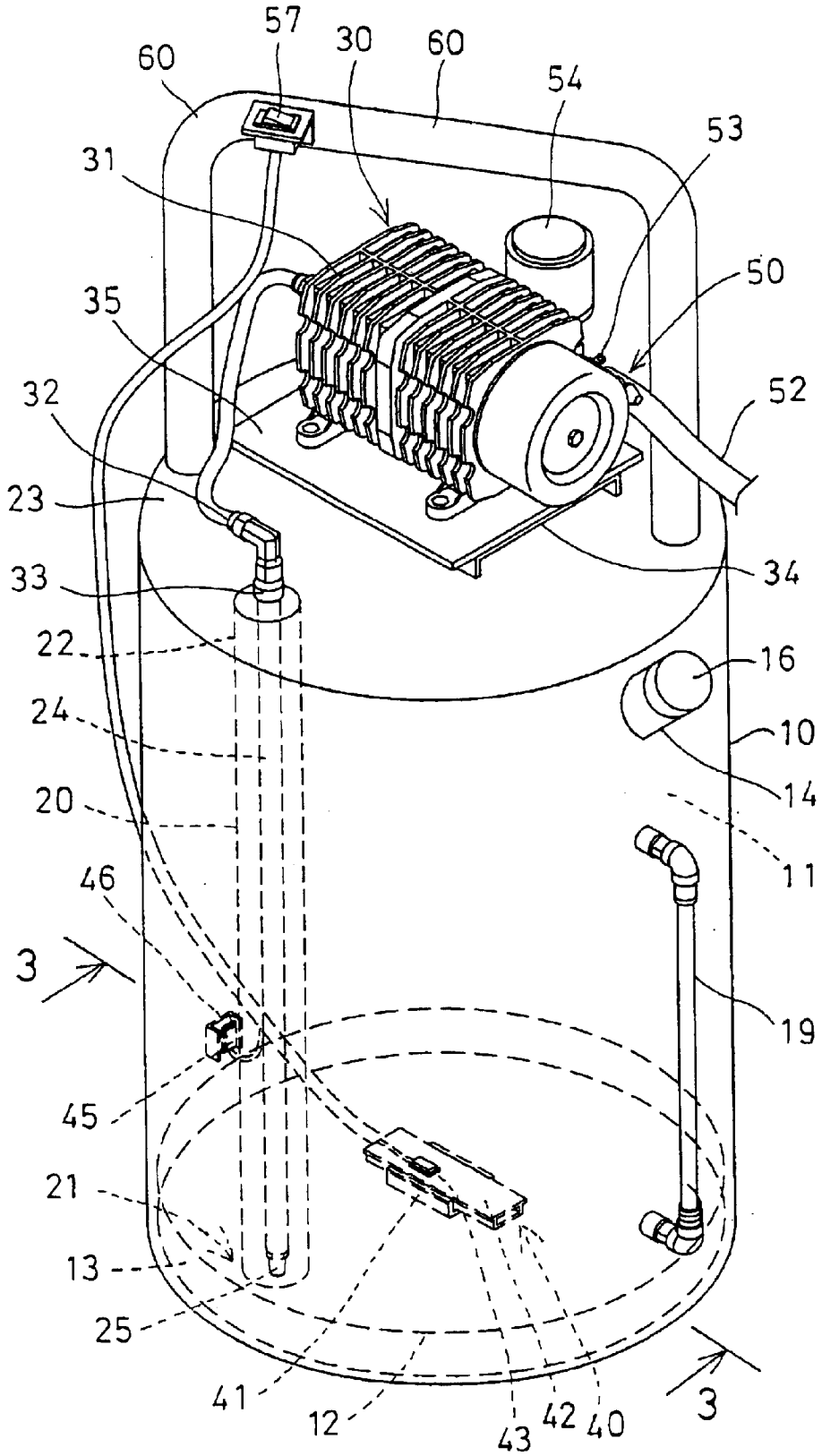
FIG. 1 is a perspective view of a fuel container in accordance with the present invention.

Referring to the drawings, and initially to FIGS. 1–4, a fuel container in accordance with the present invention comprises a container body 10 including a chamber 11 formed therein and defined by a bottom wall 12 for receiving fuel, gasoline, or petroleum 90, or compressed or liquefied petroleum gases, or other gases, such as ethyne, therein. The petroleum 90 do not completely fill the chamber 11 of the container body 10, and the petroleum 90 may be gradually gasified to gas state or to gasified petroleum 91 and flown upward toward the upper portion of the chamber 11 of the container body 10, for supplying to gas ovens or gas stoves (not shown), or the like.

The container body 10 includes a recess 13 formed in the bottom thereof and formed or defined below the bottom wall 12, and includes a port 14 having an inner thread 15 formed therein for threading with an outer thread 17 of a cap 16 which may be used to enclose the container body 10, and to stably retain the petroleum 90 within the chamber 11 of the container body 10.

Figure 2:
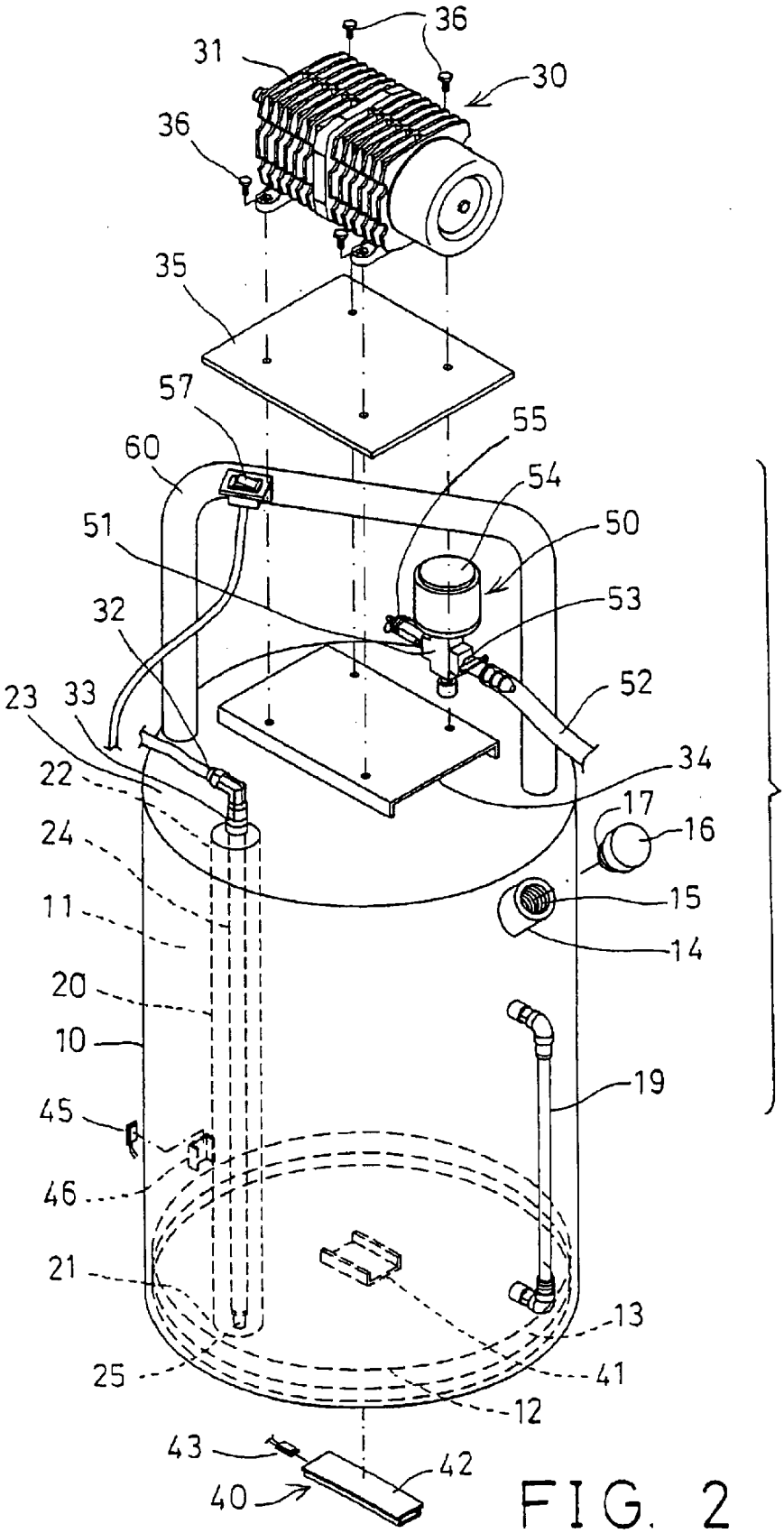
FIG. 2 is a partial exploded view of the fuel container.
Figure 3:
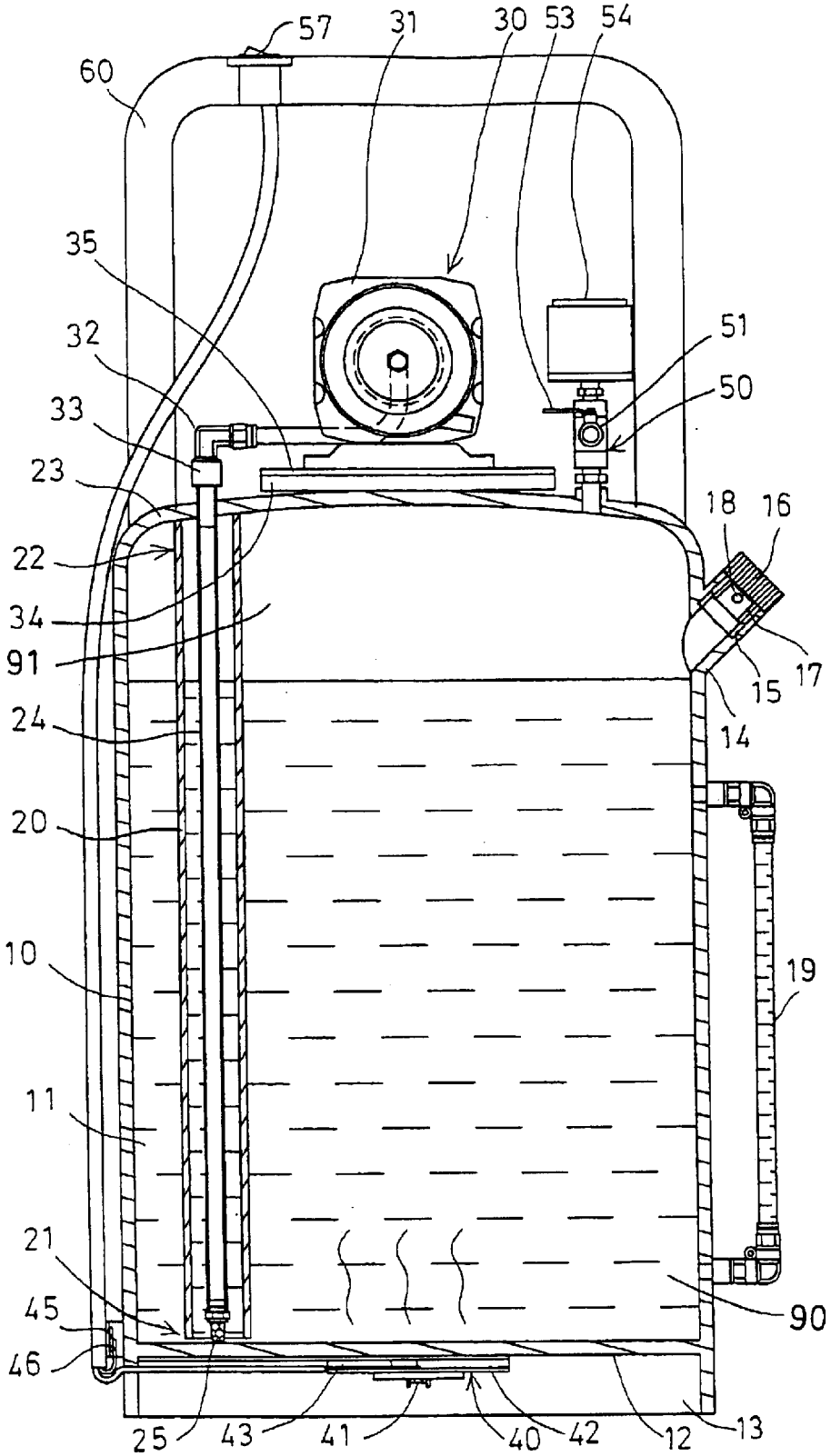
FIG. 3 is a partial cross sectional view taken along lines 3—3 of FIG. 1.
Figure 4:
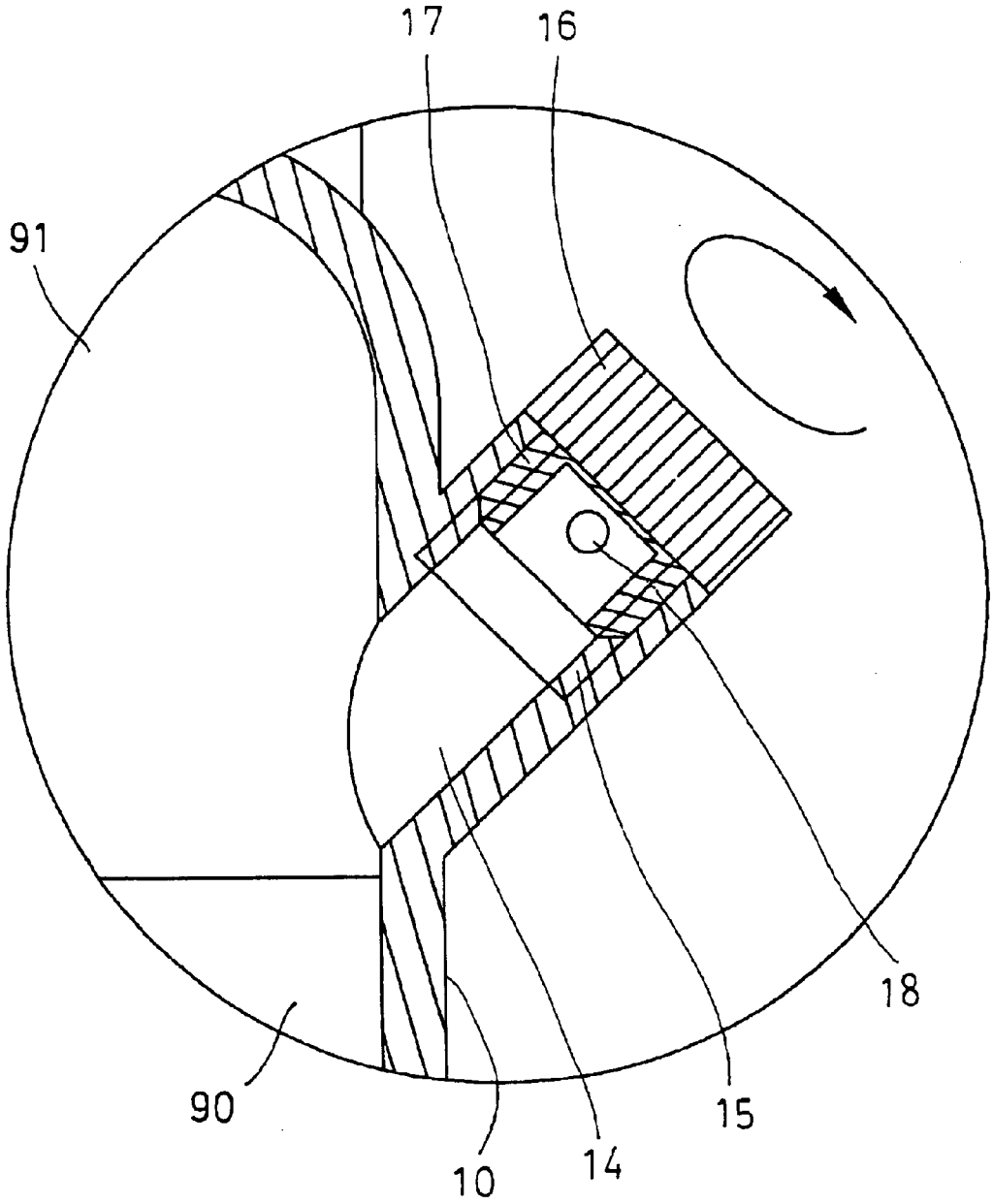
FIG. 4 is an enlarged partial cross sectional view of the fuel container.

As best shown in FIG. 4, the cap 16 includes a hole 18 formed therein and openable when the cap 16 is rotated or unthreaded relative to the port 14 of the container body 10, to relieve the gasified petroleum 91 from the container body 10, for preventing the chamber 11 of the container body 10 from being over-pressurized. The hole 18 of the cap 16 may be enclosed by rotating or threading the cap 16 relative to the port 14 of the container body 10 (FIGS. 1–3).

Figure 5:
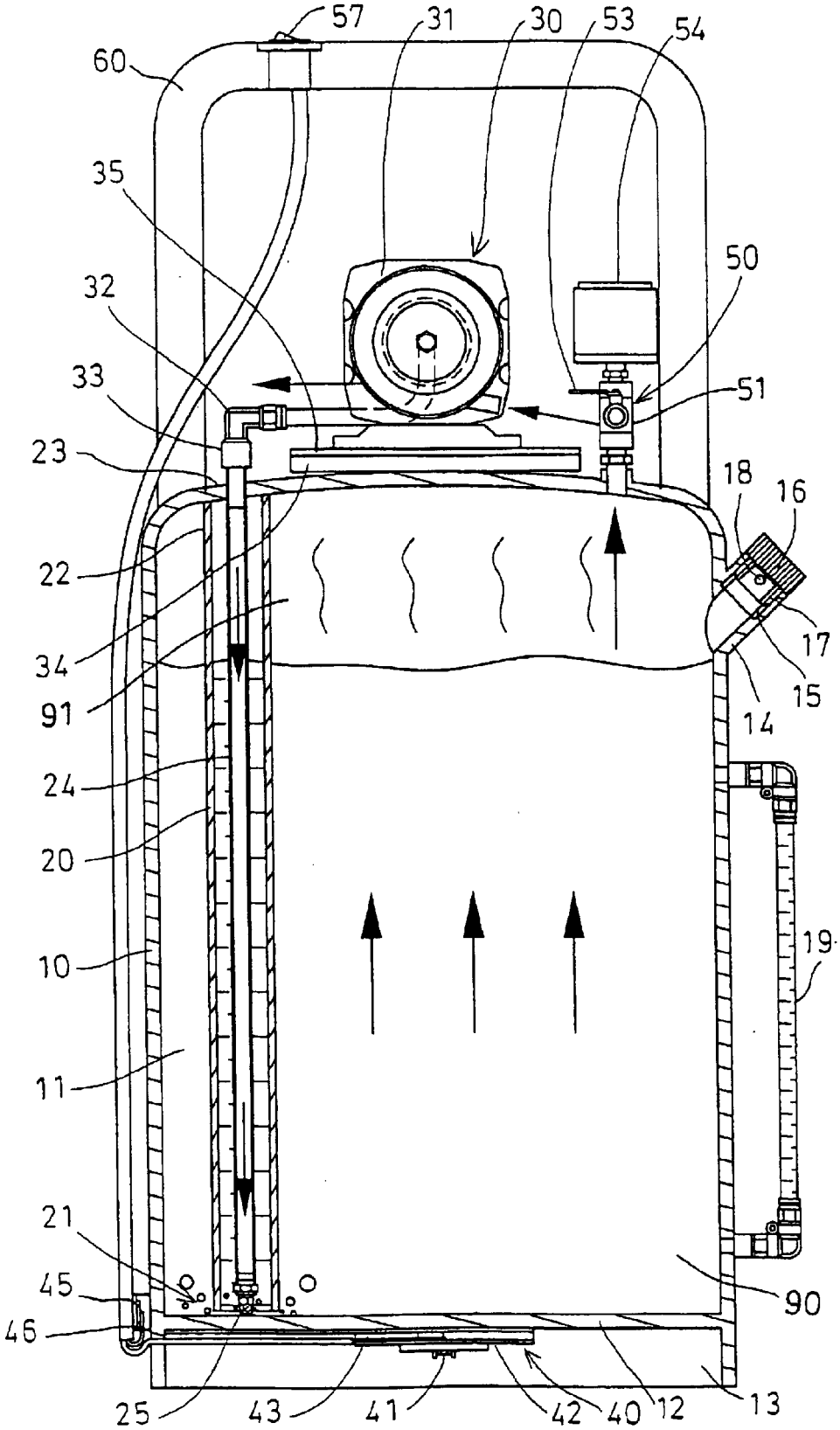
FIG. 5 is a partial cross sectional view similar to FIG. 3, illustrating the operation of the fuel container.

As best shown in FIGS. 3 and 5, it is preferable that the port 14 is provided on the upper portion of the container body 10, and communicating with the upper portion of the chamber 11 of the container body 10, to allow the gasified petroleum 91 to flow into or through the port 14 of the container body 10. It is further preferable that the port 14 is extended or inclined upwardly relative to the container body 10, and is preferably inclined for about 45 degrees relative to the container body 10.

Figure 6:
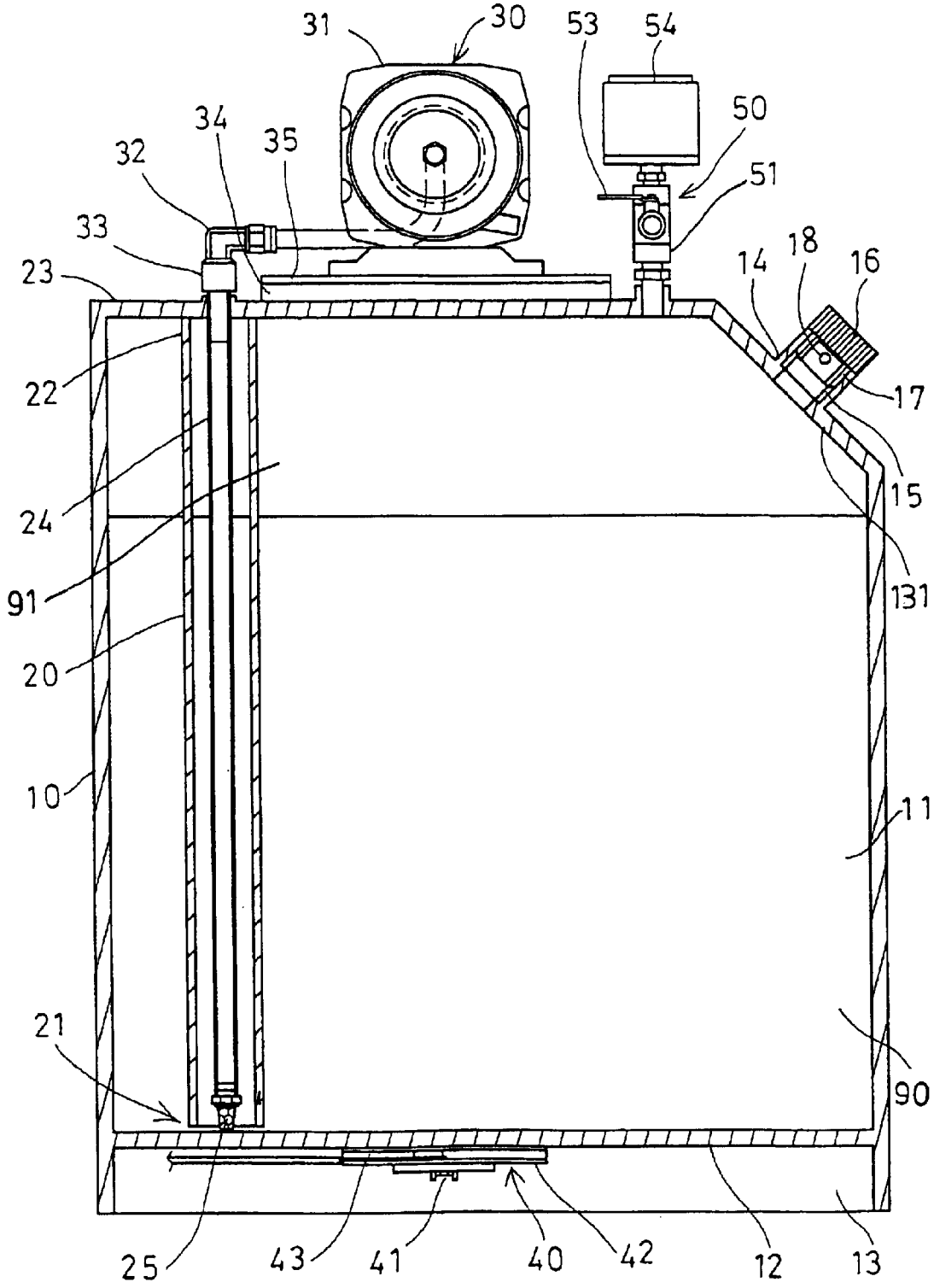
FIG. 6 is a partial cross sectional view similar to FIGS. 3 and 5, illustrating the other embodiment of the fuel container.
Figure 7:
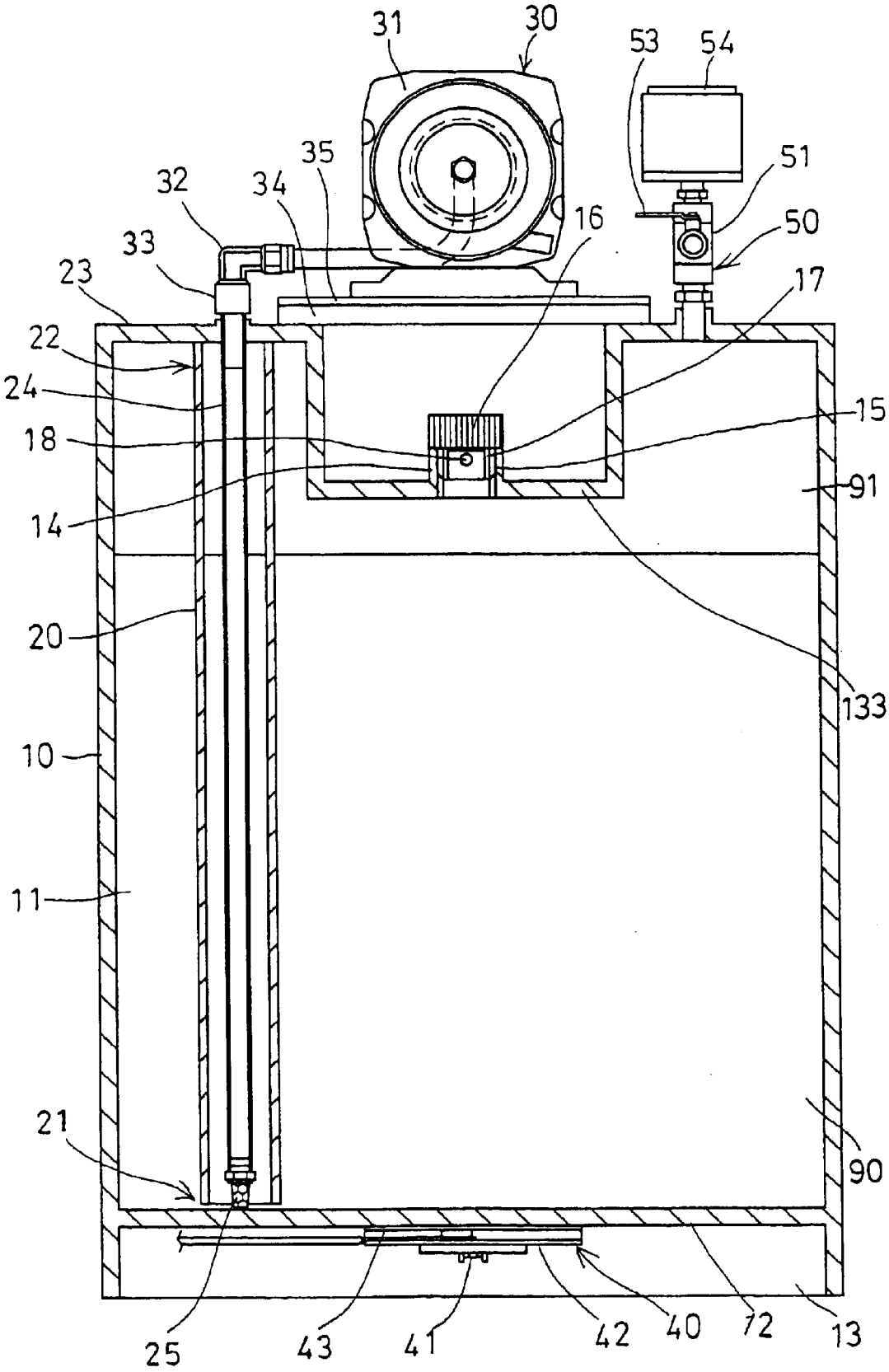
FIG. 7 is a partial cross sectional view similar to FIGS. 3, 5 and 6, illustrating a further embodiment of the fuel container.

As shown in FIG. 6, alternatively, the container body 10 may include an inclined surface 131 formed or provided on the upper portion thereof to support the port 14; or may include a casing 131 (FIG. 7) formed or provided on the upper portion thereof to support the port 14, and arranged to allow the gasified petroleum 91 to flow into or through the port 14 of the container body 10.

The container body 10 includes a gauge tube 19 attached thereto, such as attached to the side portion thereof, and communicating with the chamber 11 of the container body 10, to allow the petroleum 90 to flow into the gauge tube 19 and to be seen by the users. It is preferable that the gauge tube 19 is made of plastic materials, to allow the gauge tube 19 to be melted by fire and thus to allow the petroleum 90 to flow out of and to be released from the container body 10, and thus to prevent the container body 10 from being exploded in fire, for example.

A conduit 20 is provided or extended within the container body 10, and includes an open lower portion 21 communicating with the chamber 11 of the container body 10, to allow air or petroleum 90 to flow into the conduit 20 via the open lower portion 21 of the conduit 20. The conduit 20 may include an upper portion 22 solidly secured or attached to the upper portion 23 of the container body 10.

A pipe 24 is engaged through the upper portion 23 of the container body 10, and engaged into the conduit 20 for supplying air into the petroleum 90 that is received in the conduit 20 and/or the chamber 11 of the container body 10, in order to gasify the petroleum 90. A filter net or screen 25 is attached to the free end or the bottom end of the pipe 24, to filter and to prevent particles or dirt from entering into the petroleum 90.

An air supplying device 30 includes a pump 31 attached to the container body 10, and coupled to the pipe 24 via a coupler 32 and/or a check valve 33, in order to pump air into the conduit 20 and the chamber 11 of the container body 10. The filter screen 25 may be used to pacify the air flowing into the conduit 20 and/or the container body 10. The check valve 33 may prevent the air and the petroleum 90 that is received in the conduit 20 from flowing backward from the pipe 24 toward the coupler 32 and the pump 31.

The container body 10 may includes a seat 34 provided or disposed on the upper portion 23 thereof, and a plate 35 disposed on top of the seat 34. The pump 31 may be secured onto the plate 35 and/or the seat 34 with fasteners 36 (FIG. 2), for example. The plate 35 may be formed or selected from different areas for supporting the pumps 31 of different volumes or areas.

A heating device 40 may be provided and attached to the container body 10, with such as a bracket 41, for heating the petroleum 90 that is received in the chamber 11 of the container body 10 and/or the conduit 20, in order to heat and to gasify the petroleum 90 into the gasified petroleum 91. For example, the heating device 40 may be attached to the bottom wall 12 of the container body 10 and received in the recess 13 of the container body 10, and includes a heat conductive member 42 secured or attached to the container body 10, with the bracket 41.

The heating device 40 further includes a heater 43 attached to the heat conductive member 42, in order to heat the container body 10 via the heat conductive member 42. A thermostat or a switch 45 may further be provided and attached to the container body 10 with another bracket 46, and coupled to the heater 43, in order to maintain the petroleum 90 and/or the gasified petroleum 91 within a suitable temperature range, such as between 25 to 30° C.

For example, the thermostat or the switch 45 may automatically switch off the heater 43 when the petroleum 90 and/or the gasified petroleum 91 is heated to a temperature of about 30° C., in order to prevent the petroleum 90 and/or the gasified petroleum 91 from being over heated, and to allow the petroleum 90 and/or the gasified petroleum 91 to be easily gasified or to facilitate the gasifying of the petroleum 90, and to prevent the petroleum 90 from being overheated or exploded.

Figure 8:
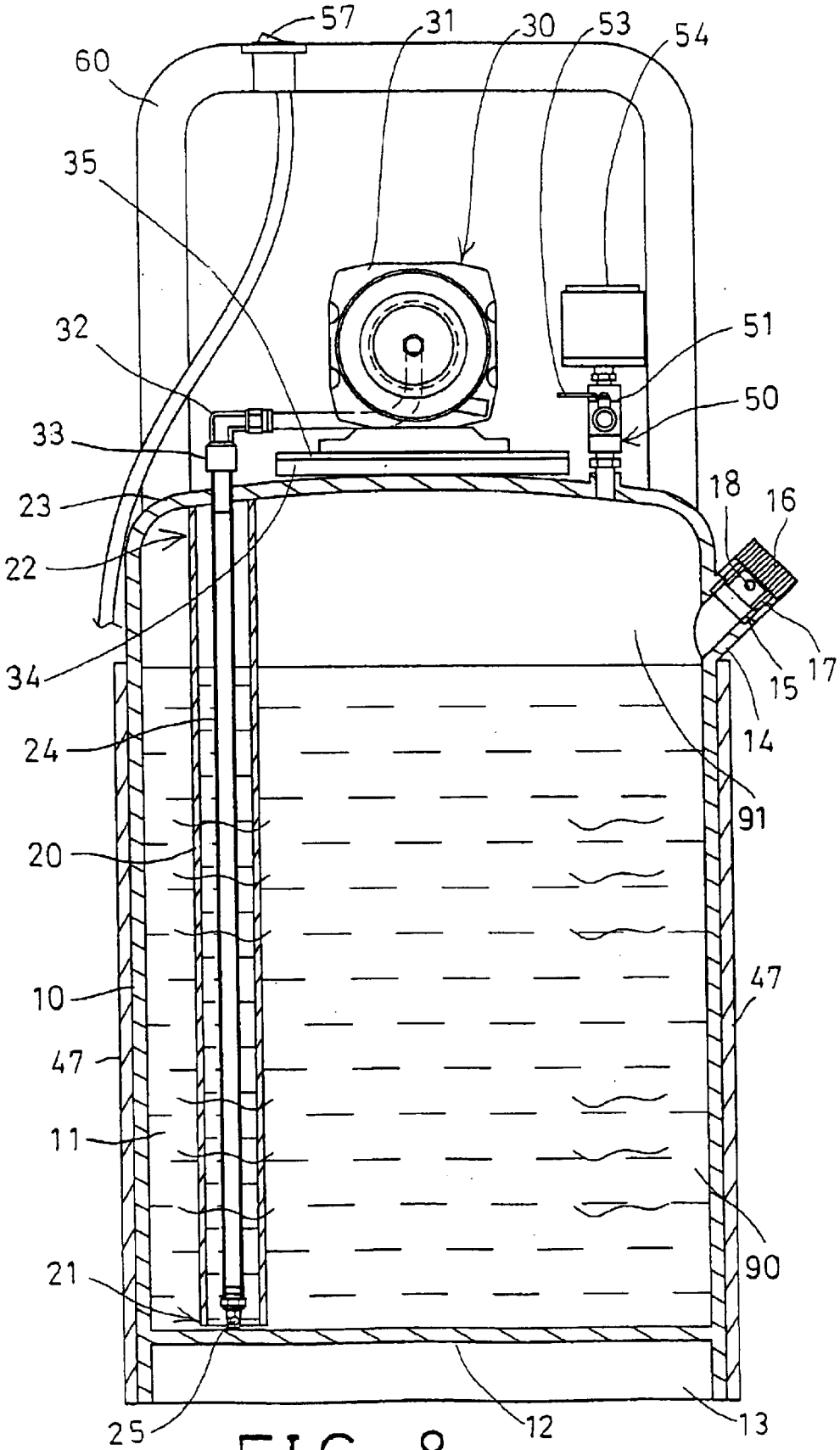
FIG. 8 is a partial cross sectional view similar to FIGS. 3, and 5–7, illustrating another embodiment of the fuel container.
Figure 9:
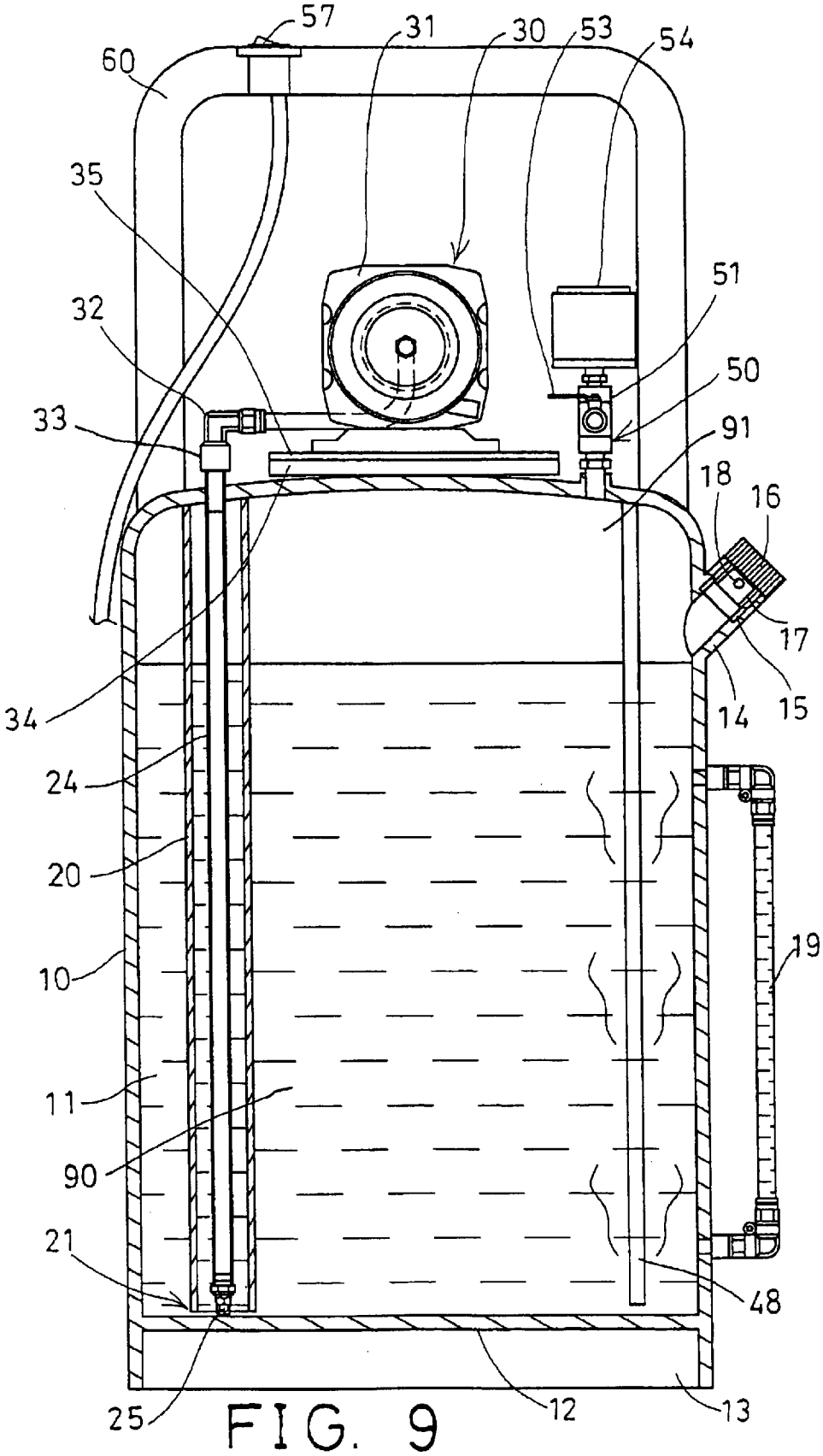
FIG. 9 is a partial cross sectional view similar to FIGS. 3 and 5–8, illustrating a still further embodiment of the fuel container.

Alternatively, as shown in FIG. 8, the heating device 40 may include a heater 47 attached or engaged onto the outer peripheral portion of the container body 10, in order to directly heat the petroleum 90 that is received in the chamber 11 of the container body 10. Further alternatively, as shown in FIG. 9, the heating device 40 may include a rod-shaped heater 48 directly engaged into the chamber 11 of the container body 10, in order to directly heat the petroleum 90 that is received in the chamber 11 of the container body 10.

An air outlet device 50 includes a valve 51 attached to the upper portion 23 of the container body 10, and coupled to the gas ovens or gas stoves or the like with a hose 52 and via an actuator or a switch 53, in order to control the gasified petroleum 91 to flow to the gas ovens or gas stoves or the like.

A manometer or a pressure gauge 54 may further be provided and attached to the valve 51, to detect the pressure within the chamber 11 of the container body 10, and to prevent the petroleum 90 and/or the gasified petroleum 91 from being over-pressurized. For example, when the manometer or the pressure gauge 54 detects that pressure within the chamber 11 of the container body 10 has reached the required or predetermined pressure, the pump 31 may be switched off to stop pumping air into the container body 10.

As shown in FIG. 2, a relieve valve 55 may further be provided and attached to the valve 51, to release the gasified petroleum 91 received in the upper portion of the chamber 11 of the container body 10, and to relieve the pressure within the container body 10 when the pressure within the chamber 11 of the container body 10 is over the required or predetermined pressure, and thus to maintain the petroleum 90 and/or the gasified petroleum 91 within the required or predetermined or suitable pressure.

The container body 10 may include a handle 60 attached to the upper portion 23 thereof, for carrying the container body 10. A control device or switch 57 may further be provided and attached to the container body 10, or to the handle 60 of the container body 10, in order to control the electric facilities, such as the pump 31, and/or the heater 43, and/or the thermostat or the switch 45, or the like.

In operation, as shown in FIG. 5, the air may be pumped into the conduit 20 and thus into the chamber 11 of the container body 10 by the pump 31 of the air supplying device 30. The pipe 24 and the conduit 20 may be arranged to allow the pressure within the conduit 20 to be greater than the pressure within the container body 10.

It is to be noted that the manometer or the pressure gauge 54 and/or the relieve valve 55 may be attached to different portions or positions of the container body 10, or may be coupled to the conduit 20, in order to release the gasified petroleum 91 received in the conduit 20, and thus to relieve the pressure within the conduit 20.

Accordingly, the fuel container in accordance with the present invention includes an air filling or supplying device to supply air into the container, and to gasify the petroleum or the compressed or liquefied petroleum gases.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A fuel container comprising:

a container body including a chamber formed therein, petroleum received in said chamber of said container body, and means for heating said petroleum received in said chamber of said container body, to gasify said petroleum further comprising an air supplying means for supplying air into said chamber of said container body.

2. The fuel container as claimed in claim 1, wherein said air supplying means includes a pipe engaged into said container body, to supply the air into said petroleum received in said chamber of said container body.

3. The fuel container as claimed in claim 2, wherein said pipe includes a free end having a filter screen attached hereto.

4. The fuel container as claimed in claim 2, wherein said air supplying means includes a pump coupled to said pipe, to pump the air into said pipe.

5. The fuel container as claimed in claim 4, wherein said air supplying means includes a check valve coupled between said pipe and said pump.

6. The fuel container as claimed in claim 1 wherein said air supplying means includes a conduit extended within said chamber of said container body, and communicating with said chamber of said container body, to allow said petroleum to flow into and out of said conduit.

7. The fuel container as claimed in claim 6, wherein said pipe is engaged into said conduit for supplying air into said petroleum received in said conduit and said chamber fo said container body.

8. The fuel container as claimed in claim 1 wherein said container body includes an air outlet device having a valve attached thereto, for controlling the air to flow out of said container body.

9. The fuel container as claimed in claim 8, wherein said air outlet device includes a switch attached to said valve, to control the air to flow out of said valve.

10. The fuel container as claimed in claim 8, wherein said air outlet device includes a pressure gauge attached to said valve, to detect a pressure within said chamber of said container body.

11. The fuel container as claimed in claim 8, wherein said air outlet device includes a relieve valve attached to said valve, to release the air received in said chamber of said container body.

12. The fuel container as claimed in 1, wherein said container body includes a port provided thereon, and a cap attached to said port to open and close said port, wherein said cap includes a hole formed therein, said hole of said cap is openable when said cap is rotated relative to said port of said container body, to prevent said container body from being over-pressurized.

13. A fuel container comprising:

a container body including a chamber formed therein, petroleum received in said chamber of said container body, and means for heating said petroleum received in said chamber of said container body, to gasify said petroleum wherein said heating means includes a heater attached to said container body, to heat said petroleum received in said chamber of said container body, further comprising a switch attached to said container body, and coupled to said heater, to control said heater and to prevent said petroleum from being over heated.

* * * * *